US005246153A

United States Patent [19]

Beletsky

[11] Patent Number: 5,246,153

[45] Date of Patent: Sep. 21, 1993

[54] AMBIDEXTROUS SHOULDER HOLSTER

[75] Inventor: Robert J. Beletsky, Temecula, Calif.

[73] Assignee: Bianchi International, Temecula, Calif.

[21] Appl. No.: 959,987

[22] Filed: Oct. 13, 1992

[51] Int. Cl.[5] ..... F41C 33/02

[52] U.S. Cl. ..... 224/192; 224/206; 224/209; 224/911

[58] Field of Search ..... 224/206, 207, 209, 192, 224/235, 239, 258-260, 901, 911, 914

[56] References Cited

U.S. PATENT DOCUMENTS

| | | | |
|---|---|---|---|
| 4,751,923 | 6/1988 | Marino | 224/206 X |
| 4,903,874 | 2/1990 | Shoemaker | 224/206 |
| 5,044,538 | 9/1991 | Bader | 224/258 |

OTHER PUBLICATIONS

1991 Catalog-Bianchi International-originally issued Dec. 1990.

*Primary Examiner*—Renee S. Luebke

*Attorney, Agent, or Firm*—Wagner & Middlebrook

[57] ABSTRACT

An ambidextrous holster includes a pistol receiving pouch with an elongated sleeve on each side, each sleeve being lined with Velcro ® loop material. Carried in one sleeve is a thumb break having Velcro ® hook material on one end which joins with the Velcro ® loop material in the sleeve to hold the thumb break securely in the sleeve. The pistol receiving pouch has two D-ring support members, one of which is carried in the same sleeve as the thumb break. The pistol receiving pouch is carried on one of two harness arrangements, one of which includes four straps, two of which carry the pistol receiving pouch and the other which carries a magazine pouch. The other harness includes a strap carried over the shoulder of the wearer. The pistol receiving pouch is reversible by placing a thin tool such as a butter knife into each sleeve, separating the Velcro ® loop and hook material and permitting the thumb break, the short strap and the safely strap to be removed and replaced in the sleeve on the opposite side of the holster.

11 Claims, 4 Drawing Sheets

FIG. 1
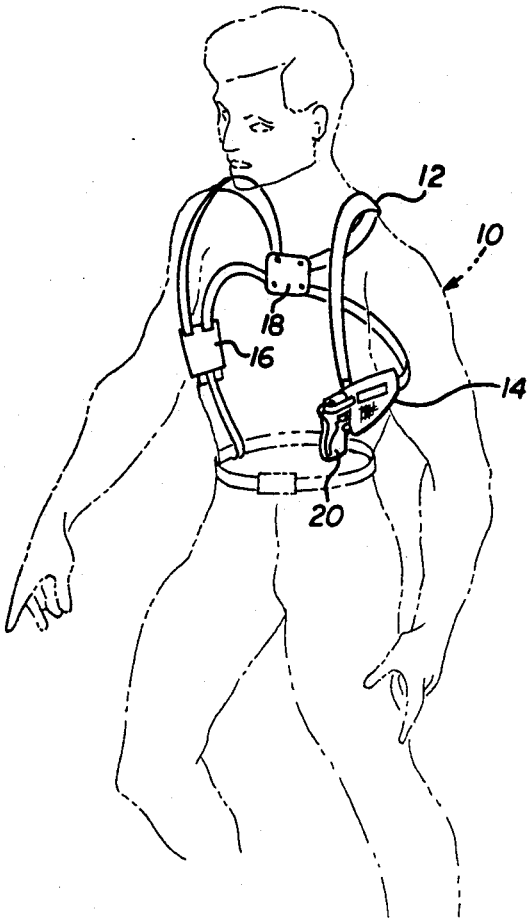
FIG. 2
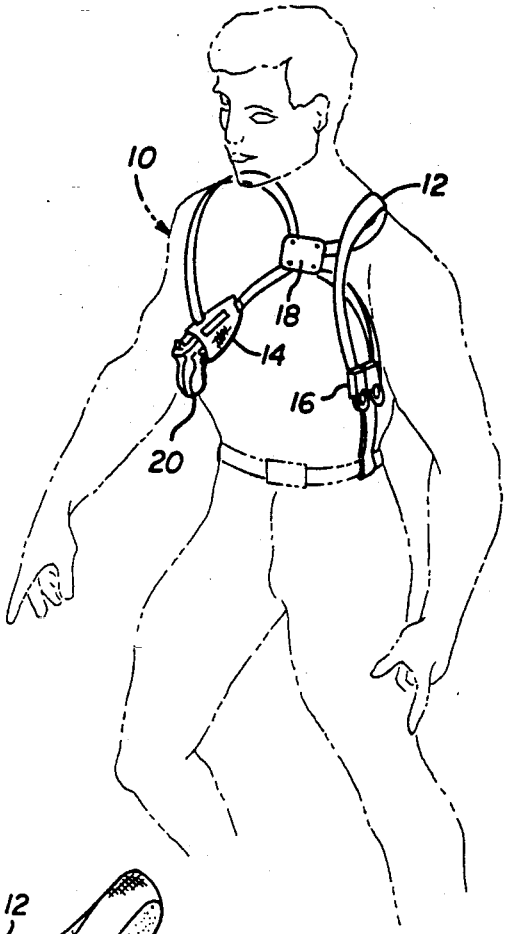
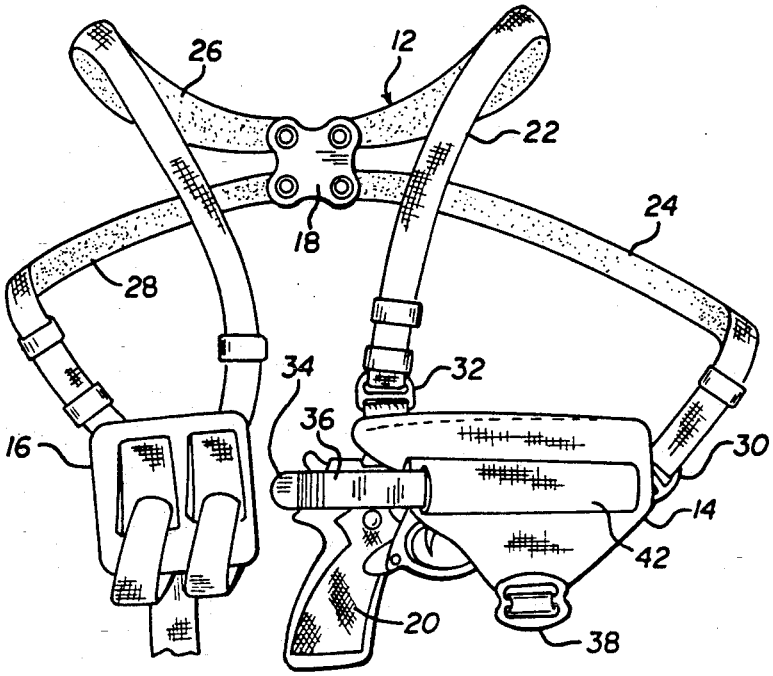
FIG. 3

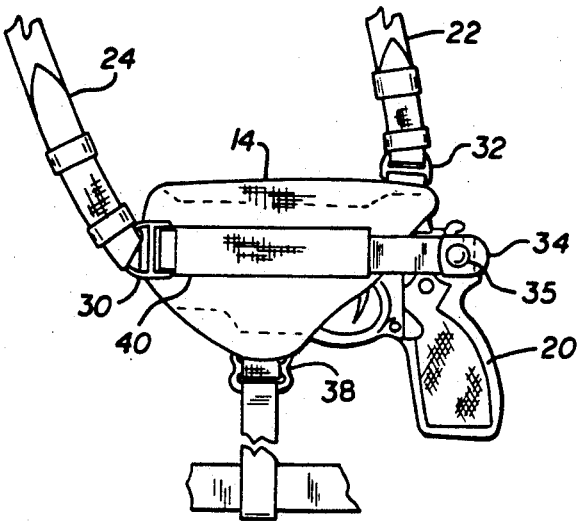
FIG. 4
FIG. 5
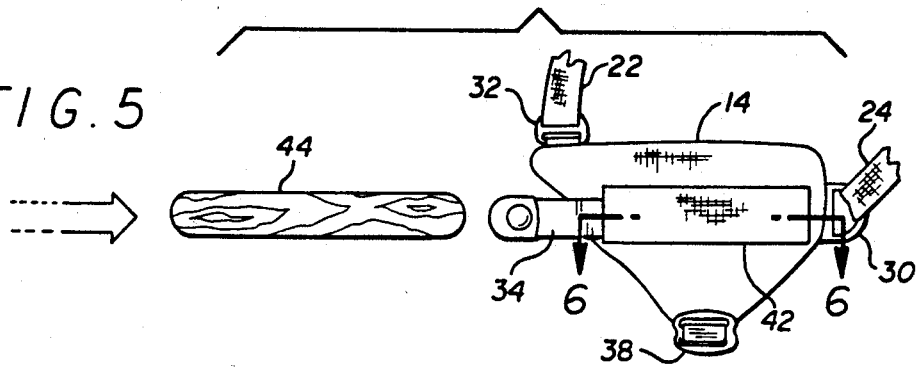
FIG. 6
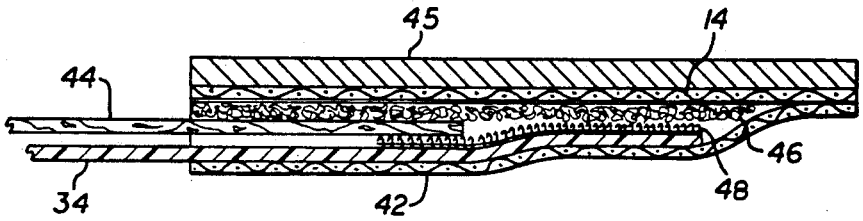
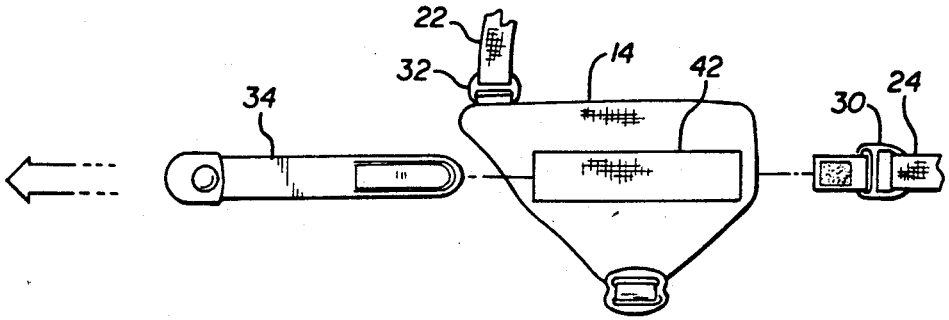
FIG. 7

FIG.8
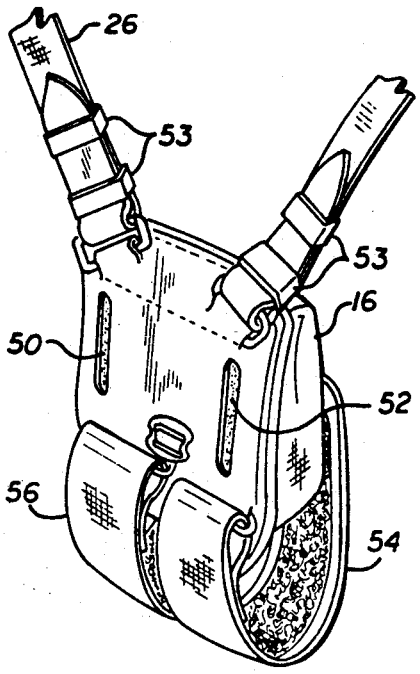
FIG.9
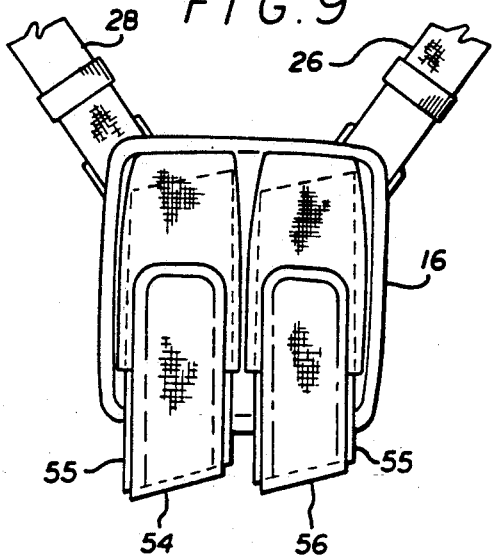
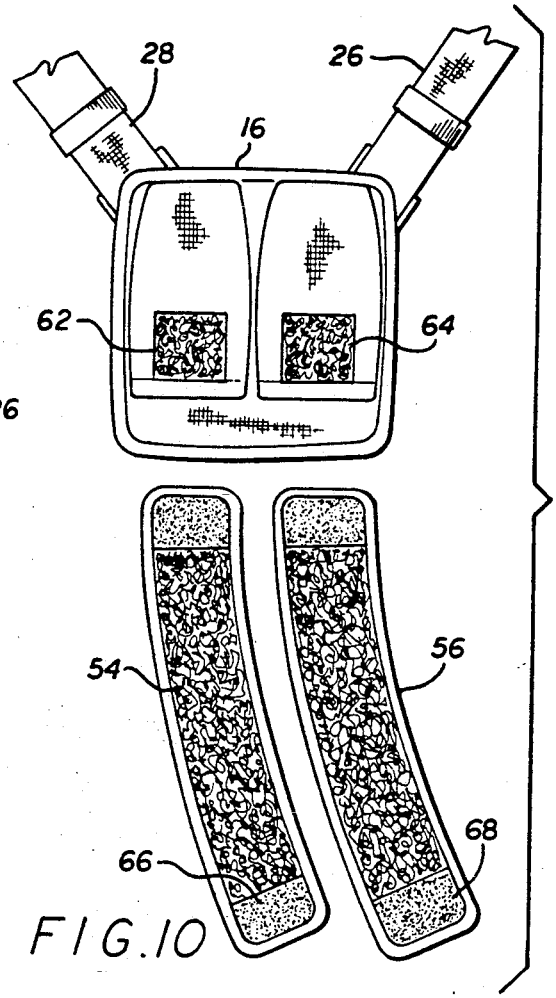
FIG.10
FIG.11
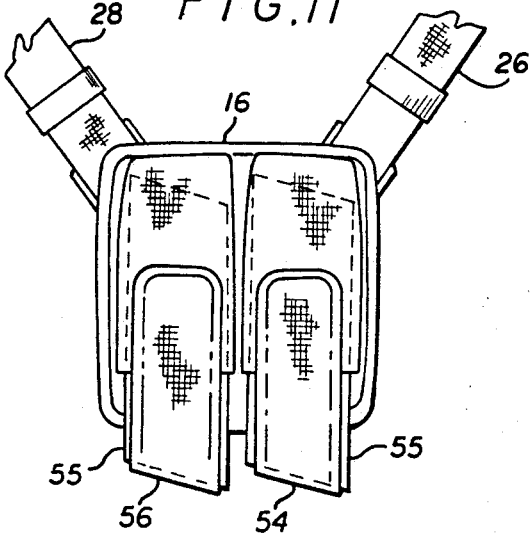

FIG. 12
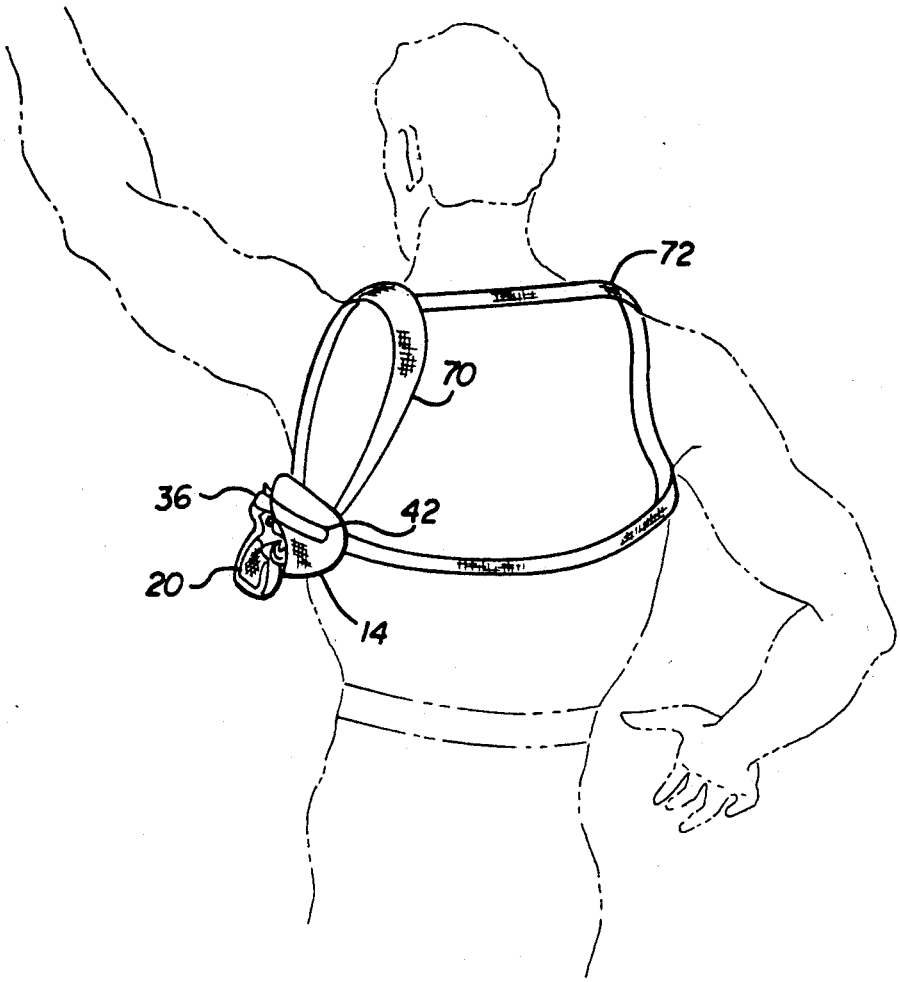
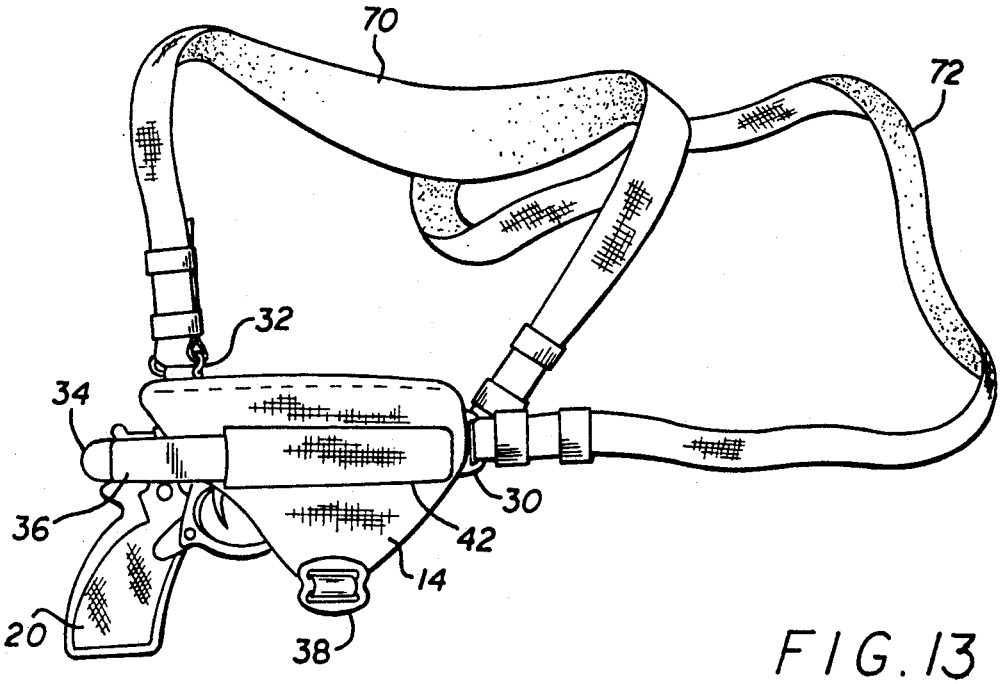
FIG. 13

AMBIDEXTROUS SHOULDER HOLSTER

BACKGROUND

This invention relates to ambidextrous shoulder holsters for pistols and more particularly to a shoulder holster having unique features making it easily convertible from right hand to left hand use.

Applicant's assignor has, in the past produced a shoulder holster which is somewhat similar to that described herein in that the holster itself is constructed of heavy duty nylon, the shoulder straps are adjustable to fit the wearer (by means of snaps posts or slides) and the holster includes a thumb break member attached to one side and a safety strap attached to the other side. These members are secured to the holster using a combination of a slide member of a synthetic elastomer and Velcro® fastening means and are reversible to change from right hand to left hand operation. This arrangement was not entirely satisfactory because the slide members, although providing reasonable resistance to shear forces tending to pull out the thumb break member or the safety strap, added an undesirable thickness to the holster, adversely affecting comfort of the wearer. Also adjusting the straps to fit the wearer by means of the conventional screw posts or snaps or slides was inconvenient and somewhat time consuming. Screw post or snap shoulder straps require the wearer to position the rig at fixed limited intervals. Sliders, although very adjustable, leave tail areas hanging.

Since a dealer would normally fit the shoulder holster to a customer, the time factor in fitting the harness and in converting from left hand to right hand operation may have a direct bearing on the costs relating to a sale. And having a convenient ambidextrous design would, of course, reduce the dealer's required inventory. Thus he might carry four sizes of a given model, but if he did not have to carry both right and left handed versions, it would reduce the inventory by half. There is thus a need for an improved ambidextrous shoulder holster providing less thickness and therefore more comfort to the wearer, in which the conversion from right hand to left hand operation is simplified and in which the adjustment of the harness to fit the wearer may more readily and quickly be accomplished.

SUMMARY OF THE INVENTION

The shoulder holster of the present invention, while somewhat similar to that described above, includes features making it significantly more comfortable to the wearer and similarly easy to convert form right hand to left hand operation. Fitting the harness to a wearer is also made easier. By providing all harness straps with Velcro® loop material for substantially all of their length and then providing Velcro® hook material at the ends of the straps, such straps can, after being doubled back through a figure 8 fastener, be quickly and easily adjusted to any desired length.

The holster of the present invention is constructed of durable nylon fabric which is suede lined and includes a pair of relatively flat fabric sleeves sewn to the sides with Velcro® loop material on the inner sides of the sleeves. The thumb break, which is a fairly stiff plastic strap member having one part of a heavy snap fastener on one end, also has fastened to one side thereof at its opposite end a length of unusually heavy Velcro® hook material. When this hook material engages the loop material on the inside of the sleeve, the resistance in shear, that is, the resistance to pulling the thumb break out of the sleeve is extremely high. Removal of the thumb break or the safety strap which carries the mating snap fastener member and is secured in the same manner in the sleeve on the opposite side of the holster, may then be accomplished by inserting a flat thin tool similar to a tongue depressor or a butter knife between the hook and loop members to disengage them. In this manner the thumb break and the safety strap may be easily removed and reversed to convert the holster from right hand to left hand operation or vice versa, yet there is essentially no possibility that either the thumb break or the safety strap will inadvertently pull out in normal use. Placing a pistol in the holster further forces the hook and loop members together.

Positioned in the same sleeve as the thumb break is a short strap with a sewn loop capturing a D-ring to which one of the harness straps is attached. For the holster to lie flat against the wearer's body, this short strap must also be changed to the opposite sleeve when the holster is reversed, so it also includes a short length of very strong hook material which engages the loop material in the sleeve. This short strap is reversed and placed in the sleeve on the opposite side of the holster in the same manner as the thumb break, as described above.

One embodiment of the present invention also includes a two magazine cartridge pouch attached to the harness. This magazine pouch normally hangs under the wearer's arm on the opposite side from the holster to provide a balance. When the holster is converted from right hand to left hand operation, the magazine pouch is also reversed. The magazine pouch stores the cartridge magazines upside-down so that when the securing straps are released, the magazines will drop conveniently into the hand of the wearer. Such magazines are parallelogram-shaped so that they fit properly in the handle of an automatic pistol and so the cartridges feed straight into the firing chamber of the pistol. Such magazines preferably are oriented to come conveniently to hand to place in the pistol without the need to turn them around.

Applicant has provided securing lids or flaps for the magazines which are Velcro® loop material for most of their length and with Velcro® hook material on the ends. A small patch of loop material is placed on the outside of each magazine pocket. Each lid is secured at one end by doubling it over a flat ring member secured at the back of the pouch and engaging the loop and hook material. At the other end, the hook material is attached to the patch of loop material on the front of the pouch. Each lid is curved such that it matches the contour of the magazine in the pouch, thereby supporting it properly. When the pouch is reversed to the left hand position, the lids also need to be reversed and the lid arrangement described makes this a simple and straightforward operation. It will also accommodate different length magazines with any easy adjustment.

BRIEF DESCRIPTION OF THE DRAWINGS

FIG. 1 is a perspective drawing of a man (shown in phantom) wearing a holster according to the present invention adapted for right hand operation;

FIG. 2 is a perspective drawing similar to that of FIG. 1, but with the holster adapted for left hand operation;

FIG. 3 is an enlarged vertical elevation of the holster and harness arrangement of FIG. 1;

FIG. 4 is a vertical elevation showing the opposite side of the holster of FIG. 3;

FIG. 5 is a vertical elevation of the holster of FIG. 3 with the pistol removed and with a flat tool in position to be inserted into a sleeve of the holster to remove the thumb break which is shown in the left hand position;

FIG. 6 is a partial sectional view taken along line 6—6 of FIG. 5 showing the tool partially inserted to disengage the hook material on the thumb break from the loop material in the sleeve;

FIG. 7 is a vertical elevation of the holster as shown in FIG. 5 with the thumb break removed from the sleeve;

FIG. 8 is an enlarged perspective rear view of the magazine pouch shown in FIGS. 1 and 2;

FIG. 9 is a front elevation of the magazine pouch of FIG. 8;

FIG. 10 is a front elevation of the magazine pouch of FIGS. 8 and 9 with the securing straps removed.

FIG. 11 is a front elevation of the magazine pouch similar to FIG. 9 but with the securing straps reversed;

FIG. 12 is a perspective view of another embodiment of shoulder holster and harness according to the invention shown worn on a man and arranged for right hand operation.

FIG. 13 is a vertical elevation of the shoulder holster of FIG. 12.

DETAILED DESCRIPTION OF THE PREFERRED EMBODIMENTS

In FIG. 1, a man 10 is shown in phantom wearing a shoulder holster harness 12 to which is attached a holster 14 and a magazine pouch 16, the pouch 16 being fastened to the belt of the wearer 10. Each of the four straps of the harness 12 are attached to a pivoting member 18 at the wearer's back and are adjustable as described below. The arrangement shown in FIG. 1 provides the wearer with the preferred configuration for drawing the pistol 20 from the holster with the right hand.

FIG. 2 shows the identical shoulder holster 14, harness 12, and magazine pouch 16 arranged on the wearer in the preferred configuration to draw the pistol 20 with the left hand.

FIG. 3 shows the harness 12 including a plurality of straps 22, 24, 26, and 28 with straps 22 and 24 attached to the holster 14 and straps 26 and 28 attached to the magazine pouch 16. Dual opening D-rings 30 and 32 are secured to the holster body and straps 22 and 24 which are made of strong web nylon material are backed for almost their entire length with Velcro® loop material and at the end opposite pivoting back member 18 include a length of Velcro® hook material such that this end may be looped through members 30 and 32 and folded back on itself to secure the straps 22 and 24 at any desired length. Straps 26 and 28 which are similarly constructed pass through flat ring members on the magazine pouch 16 and are folded back with the Velcro® hook material on the ends secured to the loop material in the same manner thus providing the desired lengths of such straps. The pistol 20 in holster 14 is secured in place by means of a somewhat stiff plastic thumb break 34 which carries part of a snap fastener which engages with a safety strap 36 carrying the mating part of the snap fastener. Thumb break 34 and safety strap 36 are each secured in narrow sleeves of nylon material stitched to the sides of the holster 14.

FIG. 4 is a vertical elevation showing the opposite side of the holster of FIG. 3. In this view it will be seen that straps 22 and 24 are visible and attached to the dual opening D-rings 30 and 32, respectively. A flattened dual opening fastener 38 is shown at the bottom of the holster and provides means for attaching a strap to a wearer's belt, if desired. As shown on FIG. 4, the thumb break member 34 is positioned within the narrow sleeve 40 sewn to holster 14.

FIG. 5 shows the holster of FIG. 3 with the pistol removed and with the thumb break member 34 positioned in narrow sleeve 42 as it would be if the holster were arranged for left hand operation. A flat tool 44 similar to a tongue depressor is movable in the direction indicated by the arrow to slide between the Velcro® hook material on thumb break 34 and the Velcro® loop material on the inside of sleeve 42 to release the thumb break member 34 so that it may be reversed and placed in sleeve 40 to convert to right hand operation. This is more clearly shown in FIG. 6 which is a sectional view taken along line 6—6 of FIG. 5. In this view the outside sleeve member 42 is shown partially separated from the side wall of holster 14 which includes a portion of the suede lining 45. The side wall which is within the sleeve 42 includes a length of Velcro® loop material shown at numeral 46. The thumb break 34 carries a significant length of extra heavy Velcro® hook material 48 which engages with the loop material 46 to hold thumb break 34 securely in the sleeve 42. When it is desired to remove the thumb break 34, the flat tool 44 is inserted in the sleeve 42 between the Velcro® loop material 46 and the hook material 48 to disengage these layers and permit the removal of thumb break 34. This is indicated in FIG. 7 wherein the thumb break 34 is shown moving to the left out and away from the sleeve 42.

FIG. 8 is an enlarged perspective rear elevational view of the magazine pouch shown in FIGS. 1 and 2. The orientation of the pouch 16 is similar to that shown in FIG. 1. The pouch 16 includes slots 50 and 52 (for optional attachment to the belt of the wearer 10 when used in other configurations). To assure ready access to the magazines carried in pouch 16, the magazines 55 (see FIG. 9) are inserted into pockets of pouch 16 and are retained in those pockets by lids 54 and 56 which include Velcro® loop material for essentially their entire length except for a small section of Velcro® hook material placed on each end permitting these lids to be fed through loop members on the pouch 16 so that each can be folded back on itself to be secured to the pouch member. To assure that the loop and hook portions of straps 26 and 28 remain engaged, the ends of these straps are secured by means of keeper rings 53, preferably used in pairs to avoid peeling back of the strap ends.

The opposite side of pouch 16 is shown in FIG. 9 wherein the ends of lids 54 and 56 are attached to Velcro® loop members on the front of pouch 16. These loop members are more clearly shown in FIG. 10 which shows the pouch member 16 in the same orientation as FIG. 9 but in which the lids 54 and 56 are completely removed disclosing the patches of Velcro® loop members 62 and 64 to which the Velcro® hook members 66 and 68 are attached. This view shows the manner in which the lids 54 and 56 are curved to support the magazines 55.

FIG. 11 is essentially the same view of pouch 16 as that shown in FIG. 9 but with lids 54, 56 reversed. When it is desired to convert from right hand to left hand operation of the holster or vice versa it is also desirable that the lids 54, 56 be reversed to properly support and secure the magazines 55 in pouch 16 when the magazines 55 are reversed. Thus it will be seen that by reversing the lids 54 and 56 the magazines 55 which are also reversed with respect to their positions in pouch 16, are property supported.

FIG. 12 is a view of another and simplified embodiment of shoulder holster arrangement according to the invention which embodiment is shown worn on a man and arranged for right hand operation. In this embodiment the holster 14 is supported on a strap 70 carried over the wearer's left shoulder.

A second strap 72 of stretchable material is attached at the center of strap 70 and to the dual opening D-ring member 30 on the holster 14 (not shown in this view). This member also has Velcro ® loop material on essentially its entire length except for a short section of Velcro ® hook material on one end permitting that end to pass through D-ring member 30 and to be folded back on itself to attach to the loop material to thereby adjust strap 72 to the desired length.

As shown in FIG. 13, the safety strap member 36 is positioned within the sleeve 42 stitched to the side of holster 14 as described above and secures pistol 20 by means of a snap fastener which engages with the thumb break member 34 on the back side of the holster 14. It will be appreciated that conversion of this embodiment from right hand to left hand use or vice versa is effected in exactly the same way as described above.

The above described embodiments of the present invention are merely descriptive of its principles and are not to be considered limiting. The scope of the present invention instead shall be determined from the scope of the following claims including their equivalents.

I claim:

1. An ambidextrous should holster including a pistol receiving pouch having a pistol retaining means and harness means for securing said holster to a wearer;

characterized in that said pistol receiving pouch includes a first elongated sleeve on one side thereof, a second elongated sleeve on the opposite side thereof, Velcro ® fastening means lining said sleeves, a thumb break secured in said first elongated sleeve having Velcro ® fastening means mating with the Velcro ® fastening means in said sleeves at one end, a short strap including a strap retaining member positioned in said first elongated sleeve, said short strap having attached thereto a section of Velcro ® fastening means mating with the Velcro ® fastening means in said sleeve and a safety strap member secured in said elongated sleeve having Velcro ® fastening means mating with the Velcro ® fastening means in said sleeves and a snap fastener operative to connect said thumb break to said safety strap.

2. An ambidextrous shoulder holster as claimed in claim 1 wherein said harness means includes a first adjustable strap attached to said pouch for passing over a wearer's shoulder nearest said pouch and a second adjustable and stretchable strap connected between said pouch and the part of said first adjustable strap passing over said shoulder, both of said adjustable straps being attached to said strap retaining member.

3. An ambidextrous shoulder holster as claimed in claim 1 wherein said harness means includes a first adjustable strap connected to said pistol receiving pouch, a second adjustable strap connected to said strap retaining member, a four-way pivoting back piece connected to said first and second straps, a magazine pouch and third and fourth adjustable straps connected between said four-way back piece and said magazine pouch, said first, second, third and fourth straps all being of strong fabric backed for most of their length with Velcro ® loop material and having a short length of Velcro ® hook material at their ends opposite said four-way back piece.

4. An ambidextrous shoulder holster as claimed in claim 3 wherein said magazine pouch includes at least one pocket for holding a cartridge magazine, said pocket being open at the bottom, a flat ring retainer at the rear side of said magazine pouch, a lid of strong fabric having Velcro ® loop material on its inside surface and with an area of Velcro ® hook material at each end permitting said lid to be looped over said ring retainer securing one end thereof to itself to hold said lid on said magazine, and an area of Velcro ® loop material fastened to the front side of said magazine pouch adapted to join with the Velcro ® hook material on the opposite end of said lid to retain a magazine in said magazine pouch.

5. An ambidextrous shoulder holster including a pistol receiving pouch, a magazine receiving pouch, a first adjustable strap attached to said pistol receiving pouch, a second adjustable strap fastened to said magazine receiving pouch, a four way pivoting back piece connected to said first and second adjustable straps, a third adjustable strap connected between said pistol receiving pouch and said back piece, a fourth adjustable strap connected between said magazine receiving pouch and said back piece;

characterized in that said pistol receiving pouch includes a first elongated sleeve on one side thereof, a second elongated sleeve on the opposite side thereof, Velcro ® fastening means lining said sleeves, a thumb break secured in said first elongated sleeve having Velcro ® fastening means mating with the Velcro ® fastening means in said sleeves at one end, a short strap including a strap retaining member positioned in said first elongated sleeve, said short strap having attached thereto a section of Velcro ® fastening means mating with the Velcro ® fastening means in said sleeve and a safety strap member secured in said second elongated sleeve having Velcro ® fastening means mating with the Velcro ® fastening means in said sleeves and a snap fastener operative to connect said thumb break to said safety strap.

6. An ambidextrous shoulder holster including a pistol receiving pouch, a first adjustable strap attached to said pouch for passing over a wearer's shoulder nearest said pouch and a second adjustable and stretchable strap for passing over the wearer's opposite shoulder connected between said pouch and said first adjustable strap, said pouch including retaining means for securing said pistol in said holster;

characterized in that said pouch includes first and second elongated sleeves fastened to opposite sides thereof, one of Velcro ® loop and hook fastening members lining one side of said sleeves, said retaining means including a flexible strap member in one of said sleeves and a thumb break in the other of said sleeves, each of said flexible strap member and said thumb break having at one end thereof the other of said Velcro® loop and hook fastening members attached thereto and each also having one of the mating parts of a fastener at its opposite end.

7. An ambidextrous shoulder holster as claimed in claim 6 wherein a short strap including a strap retaining member holding said first and second adjustable straps is positioned in one of said sleeves, said short strap also having attached thereto a short section of the other of said Velcro® loop and hook fastening members.

8. An ambidextrous shoulder holster as claimed in claim 7 wherein said sleeves are lined with Velcro® loop material and said thumb break, said flexible strap member and said short strap have attached thereto sections of extra heavy Velcro® hook material.

9. For use with an ambidextrous shoulder holster including a harness, a magazine pouch having front and rear sides attached to said harness including at least one pocket for holding a cartridge magazine, said pocket being open at the bottom, a flat ring retainer at the rear side of said magazine pouch, a lid of strong fabric having one of Velcro® loop or hook material on its inside surface and with an area of the other of Velcro® loop or hook material at each end permitting said lid to be looped over said ring retainer securing one end thereof to itself to hold said lid on said magazine, and an area of said one Velcro® loop or hook material fastened to the front side of said magazine pouch adapted to join with the other said Velcro® loop or hook material on the opposite end of said lid to retain a magazine in said magazine pouch.

10. A magazine pouch as claimed in claim 9 wherein said lid is curved to provide support across the width of said cartridge magazine when said magazine is in said pouch and when said magazine pouch is changed from right hand to left hand operation or vice versa and said cartridge magazine is reversed in position in said pouch, said lid may be removed from said pouch, reversed end for end, and reattached to again support said magazine cartridge across its width.

11. A magazine pouch as claimed in claim 9 wherein Velcro® loop material is located on said inside surface of said lid with Velcro® hook material at each end.

* * * * *